US006062810A

United States Patent [19]

Miyamoto et al.

[11] Patent Number: 6,062,810

[45] **Date of Patent: *May 16, 2000**

[54] TURBOMOLECULAR PUMP

[75] Inventors: Matsutaro Miyamoto, Chigasaki; Hiroshi Sobukawa, Fujisawa; Toshiharu Nakazawa, Chigasaki; Atsushi Shiokawa; Junichi Arami, both of Tokyo, all of Japan

[73] Assignees: Ebara Corporation; Tokyo Electron Limited, both of Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/133,332

[22] Filed: Aug. 13, 1998

[30] Foreign Application Priority Data

Aug. 15, 1997 [JP] Japan ..... 9-235437

[51] Int. Cl.[7] ..... F04D 15/00; F04B 49/22; F04B 17/00

[52] U.S. Cl. ..... 415/90; 415/90; 415/151; 415/156; 415/157; 417/505; 417/423.4; 251/318

[58] Field of Search ..... 415/90, 151, 156, 415/157; 417/505, 423.4; 251/318

[56] References Cited

U.S. PATENT DOCUMENTS

| | | | |
|---|---|---|---|
| 4,193,742 | 3/1980 | Fischer et al. | 417/295 |
| 4,588,361 | 5/1986 | Saulgeot | 417/424 |
| 4,926,648 | 5/1990 | Okumura et al. | 62/55.5 |
| 5,209,631 | 5/1993 | Bernhardt | 415/90 |
| 5,443,368 | 8/1995 | Weeks et al. | 417/27 |
| 5,522,694 | 6/1996 | Bernhardt et al. | 415/14 |

FOREIGN PATENT DOCUMENTS

| | | |
|---|---|---|
| 0 332 107 A1 | 9/1989 | European Pat. Off. . |
| 0 397 051 A1 | 11/1990 | European Pat. Off. . |
| 3-107599 | 5/1991 | Japan . |
| 8-68389 | 3/1996 | Japan . |

OTHER PUBLICATIONS

Patent Abstracts of Japan; vol. 18, No. 249 (M–1604), May 12, 1994 & JP 06 033874 A (Ulvac Kuraio KK), *abstract*.

*Primary Examiner*—F. Daniel Lopez
*Assistant Examiner*—Rhonda Barton
*Attorney, Agent, or Firm*—Armstrong, Westerman, Hattori, McLeland & Naughton

[57] ABSTRACT

A turbomolecular pump evacuates gas in an apparatus (or a chamber) by means of a rotor having blades and/or spiral grooves which rotates at a high speed. The turbomolecular pump includes a casing housing a rotor and a stator therein, a pumping section comprising the rotor and the stator, a valve element capable of opening or closing an intake port of the casing, and a supporting member for supporting the valve element. The supporting member extends through at least one of the rotor and the stator. The turbomolecular pump further includes an actuating mechanism for actuating the valve element, and the actuating mechanism is provided at a side opposite to the intake port with respect to the rotor.

5 Claims, 6 Drawing Sheets

TURBOMOLECULAR PUMP

BACKGROUND OF THE INVENTION

1. Field of the Invention

The present invention relates to a turbomolecular pump for evacuating gas by means of a rotor having blades and/or spiral grooves which rotates at a high speed.

2. Description of the Related Art

FIG. 6 shows a conventional turbomolecular pump. The turbomolecular pump comprises a rotor R having a main shaft 10 and a rotating cylindrical section 12 which rotates integrally with the main shaft 10, a stator S having a stationary cylindrical section 14 which surrounds the main shaft 10, and a cylindrical casing 16 which surrounds the rotating cylindrical section 12. A base B is fixed to the stationary cylindrical section 14. Between an apparatus (or a chamber) to be evacuated and the turbomolecular pump, there are provided a conductance adjustment valve 100 and a gate valve 110.

However, in the conventional turbomolecular pump shown in FIG. 6, since drive mechanisms of the respective valves are provided adjacent to the respective valves, the overall structures of the valves are extremely enlarged to thus increase the size of the overall structures of the turbomolecular pump including the valves.

SUMMARY OF THE INVENTION

It is therefore an object of the present invention to provide a turbomolecular pump, including a valve, which is compact in size.

According to the present invention, there is provided a turbomolecular pump comprising: a casing housing a rotor and a stator therein; a pumping section comprising the rotor and the stator; a valve element capable of opening or closing an intake port of the casing; a supporting member for supporting the valve element, the supporting member extending through at least one of the rotor and the stator; and an actuating mechanism for actuating the valve element, the actuating mechanism being provided at a side opposite to the intake port with respect to the rotor.

According to the present invention, since the actuating mechanism of the valve is provided at an opposite side of the intake port, the intake port of the turbomolecular pump can be directly connected to the duct of the apparatus to be evacuated. Further, since the valve actuating mechanism can actuate the valve supporting member for supporting the valve element in a direction of the axis of the rotor, the structure of the valve and its actuating mechanism become simple. Therefore, the overall structure of the turbomolecular pump including the valve can be compact.

The turbomolecular pump further comprises a sealing portion provided between a part of the supporting member and the rotor to prevent counterflow of gas. This arrangement prevents gas from flowing back through the through hole from the gas exhaust port side to the gas intake port side.

The turbomolecular pump further comprises a bearing provided near the intake port for supporting at least a part of the supporting member. This arrangement allows the valve supporting member to be supported stably to thus prevent displacement of the valve element, and allows the valve element to open or close smoothly.

The turbomolecular pump further comprises a gas purge mechanism for supplying purge gas to around the bearing, and the purge gas carries downstream particles which may be produced from the bearing. This arrangement prevents contamination of the apparatus to be evacuated due to particles which may be produced from the bearing.

The turbomolecular pump further comprises an auxiliary valve element capable of opening or closing an opening formed in the valve element. This arrangement allows the conductance to be adjusted in two steps, and the precision of adjustment in the conductance in regions where the conductance is small can be improved.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENTS

A turbomolecular pump according to embodiments of the present invention will be described below with reference to drawings.

Figure 1:
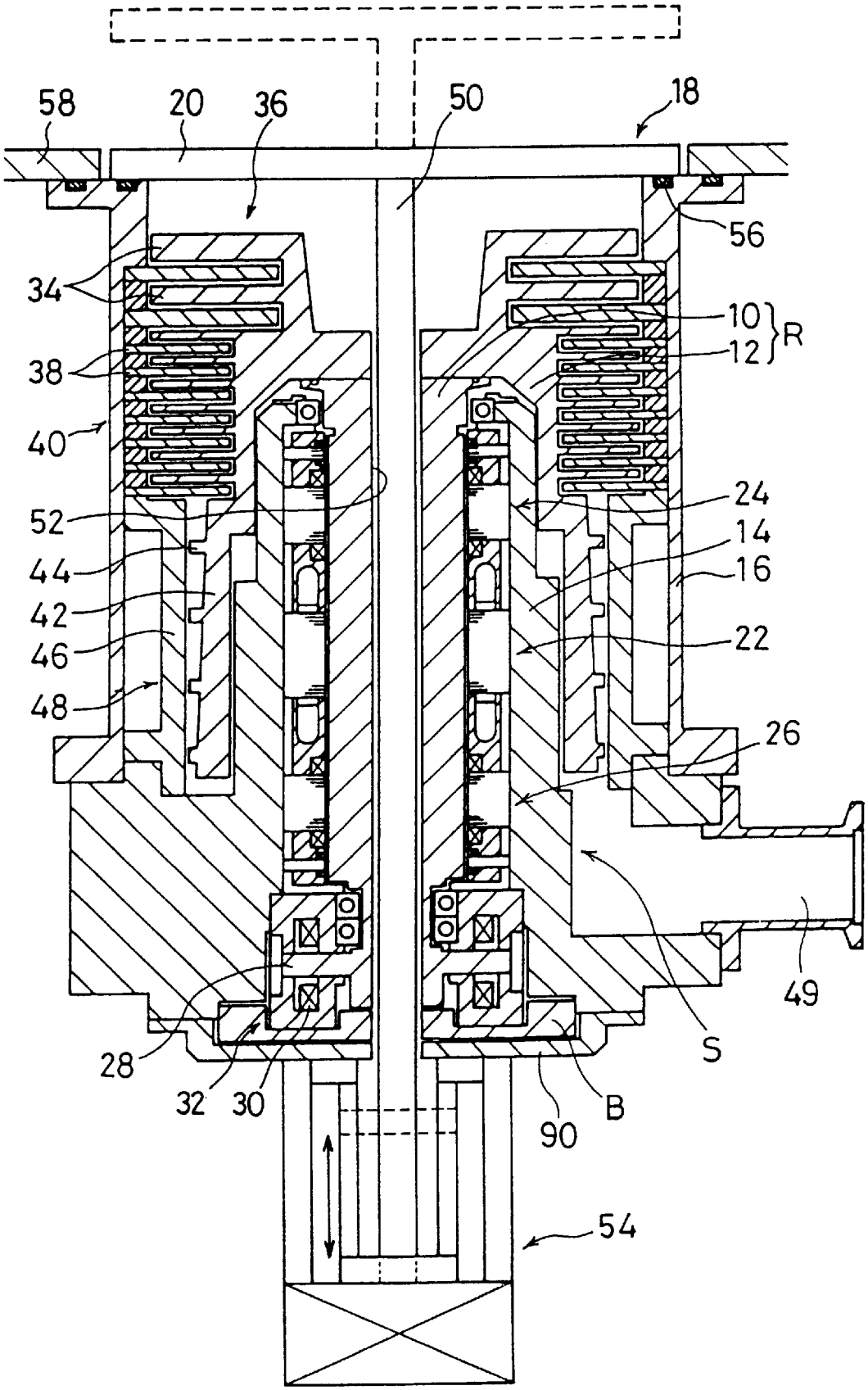
FIG. 1 is a cross-sectional view of a turbomolecular pump according to a first embodiment of the present invention.

FIG. 1 is a cross-sectional view of a turbomolecular pump according to the first embodiment of the present invention. As shown in FIG. 1, a turbomolecular pump comprises a rotor R having a main shaft 10 and a rotating cylindrical section 12 which rotates integrally with the main shaft 10, a stator S having a stationary cylindrical section 14 which surrounds the main shaft 10, and a cylindrical casing 16 which surrounds the rotating cylindrical section 12. A base B is fixed to the stationary cylindrical section 14, and a cover 90 is provided to cover the base B. The base B and the cover 90 constitute a part of the stator S. A valve element 20 is provided to open or close a gas intake port 18 of the casing 16.

A drive motor 22 for rotating the rotor R is provided between the main shaft 10 and the stationary cylindrical section 14, and upper and lower radial bearings 24 and 26 are provided above and below the drive motor 22. At the lower part of the main shaft 10, there is provided an axial bearing 32 comprising a target disk 28 provided at the lower end of the main shaft 10 and upper and lower coils 30 provided on the stator S. By the above arrangement, the rotor R is rotated at a high speed by the drive motor 22 under five-axis active control. Rotating blades 34 are integrally provided on the outer circumferential surface of the rotating cylindrical section 12 to thus form an impeller 36, and stationary blades 38 which alternate with the rotating blades 34 are provided on the inner circumferential surface of the casing 16. A blade pumping section 40 which evacuates gas by the interaction of the rotating blades 34 which rotate at a high speed and the stationary blades 38 which are stationary is formed.

A spiral groove section 42 extending downwardly along the outer circumferential surface of the stationary cylindrical section 14 is integrally provided on the rotating cylindrical section 12. The spiral groove section 42 has spiral grooves 44 on the outer circumferential surface thereof. A spacer 46 surrounding the outer circumferential surface of the spiral groove section 42 is provided on the stator S. A spiral groove pumping section 48 which evacuates gas by a drag effect of the spiral grooves 44 of the spiral groove section 42 which rotates at a high speed is formed between the blade pumping section 40 and a gas exhaust port 49.

A through hole 52 for allowing a valve rod 50 for supporting the valve element 20 to be inserted therein is formed in the main shaft 10, the rotating cylindrical section 12, the base B and the cover 90. An actuator 54 for actuating the valve element 20 by means of the valve rod 50 in an axial direction of the rotor R is attached to the cover 90. That is, the actuator 54 is provided at a side opposite to the gas intake port 18 with respect to the rotor R. An O-ring 56 is provided on the upper end of the casing 16 at a position contacting the valve element 20 to close the gas intake port 18 in an airtight manner. A sealing mechanism is also provided at the coupling portion between the cover 90 and the actuator 54.

Figure 6:
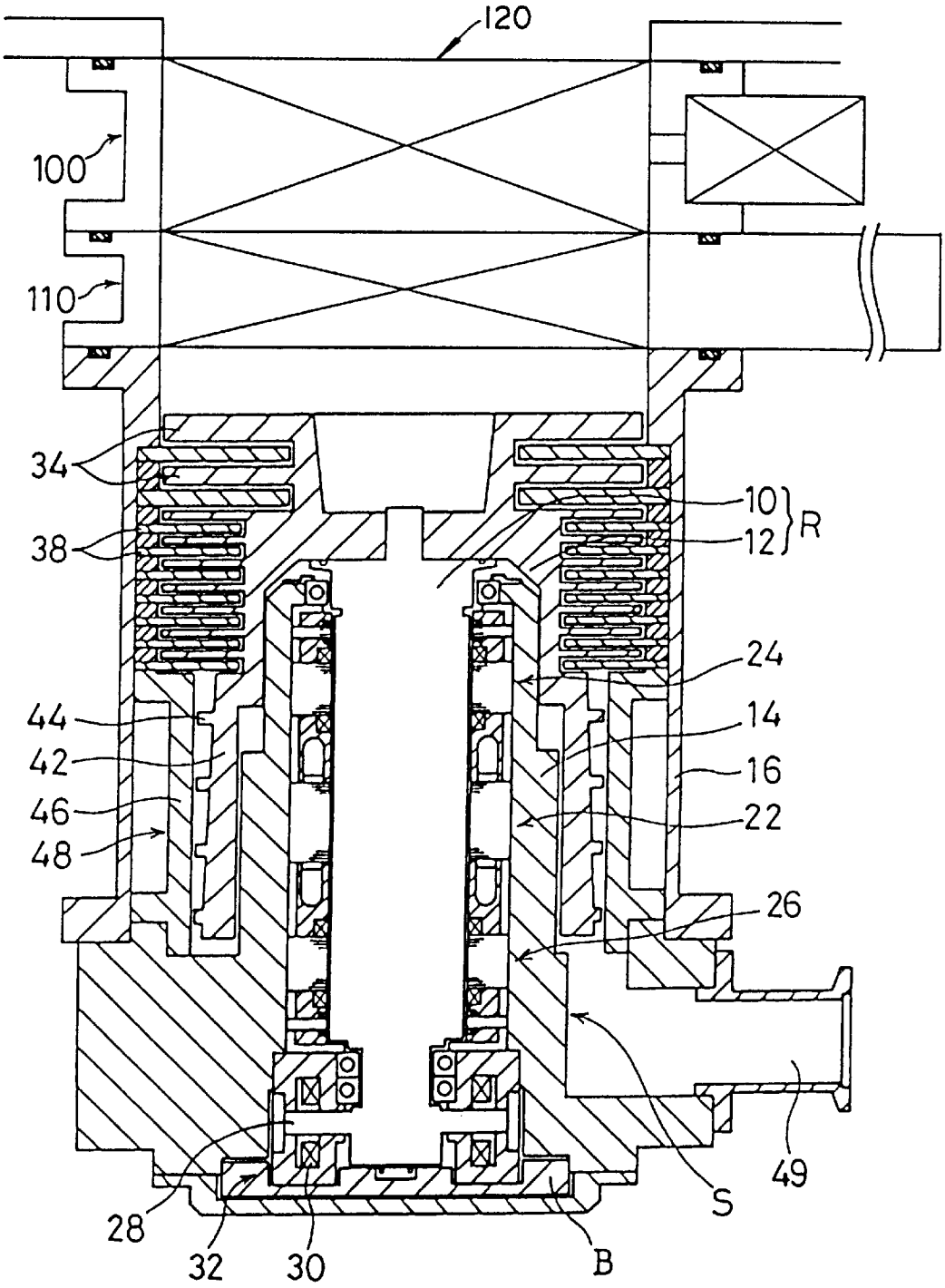
FIG. 6 PRIOR ART
FIG. 6 is a cross-sectional view of a conventional turbomolecular pump.

With the above arrangement, the valve element 20 is actuated to open or close the gas intake port 18 by the actuator 54, and the conductance can be adjusted by moving the valve element 20 up to given positions. This turbomolecular pump can be attached directly to a duct 58 or the like of an apparatus (or chamber) to be evacuated without providing the conductance adjustment valve and the gate valve as shown in FIG. 6. Further, the actuator 54 can move the valve element 20 in a direction of the axis of the rotor R to open or close the gas intake port 18, thus making the structures of the valve and its driving (actuating) mechanism simple. As a result, the overall structure of the turbomolecular pump becomes compact, and the turbomolecular pump can be installed in a narrow space defined in a room such as a clean room.

Figure 2:
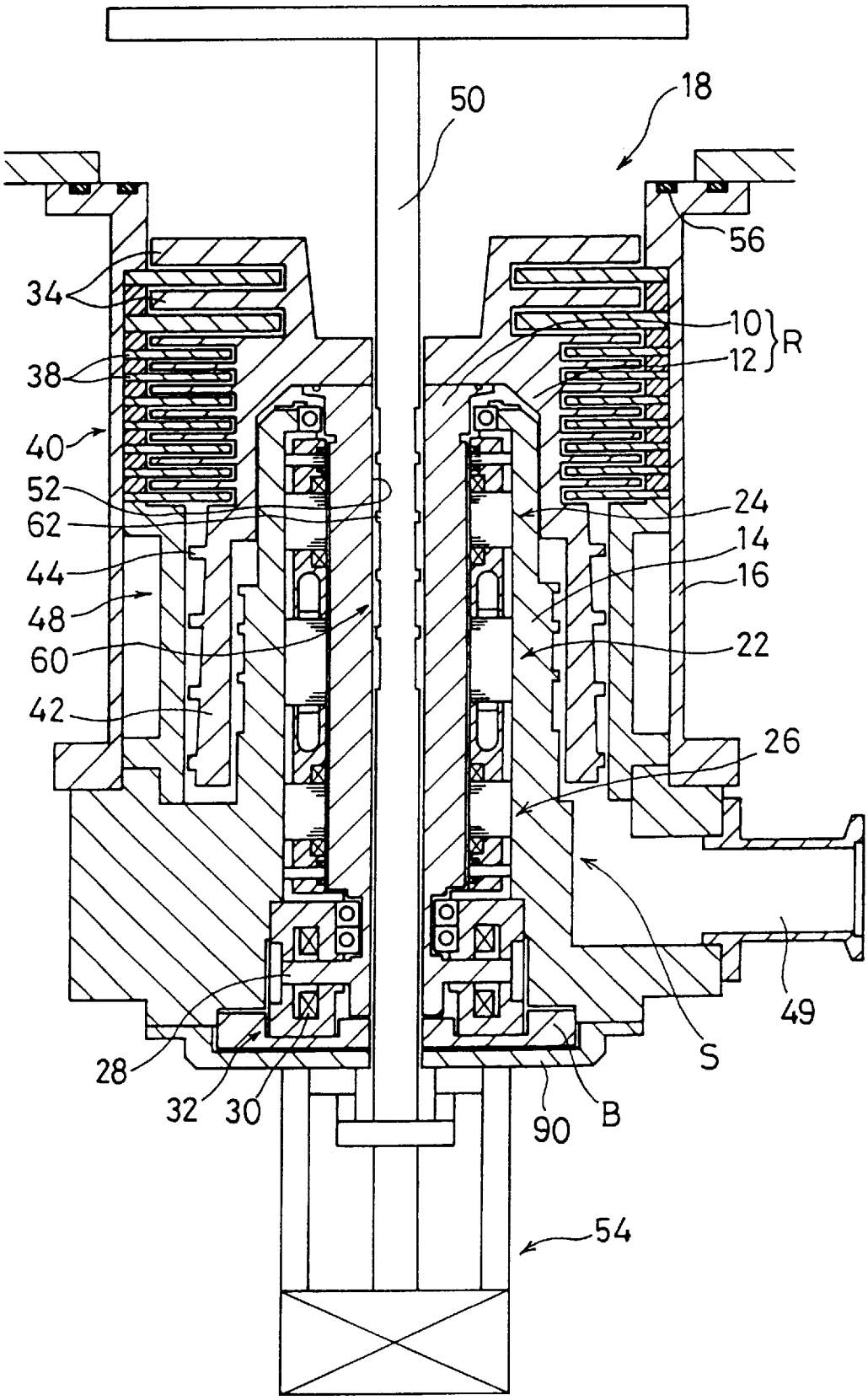
FIG. 2 is a cross-sectional view of a turbomolecular pump according to a second embodiment of the present invention.

FIG. 2 shows the turbomolecular pump according to the second embodiment of the present invention. As shown in FIG. 2, a screw sealing portion 60 is formed between the valve rod 50, and the through hole 52 surrounding the valve rod 50 and formed in the main shaft 10. The screw sealing portion 60 serves to prevent gas which has already been evacuated from flowing back from the gas exhaust port 49 to the gas intake port 18 through a gap between the stationary cylindrical section 14 and the rotating cylindrical section 12, a gap between the stationary cylindrical section 14 and the main shaft 10, and the through hole 52. Therefore, screws 62 are formed on the outer circumferential surface of the valve rod 50 so that the drag effect is created downwardly in the illustrative example by the rotation of the rotor R.

Figure 3:
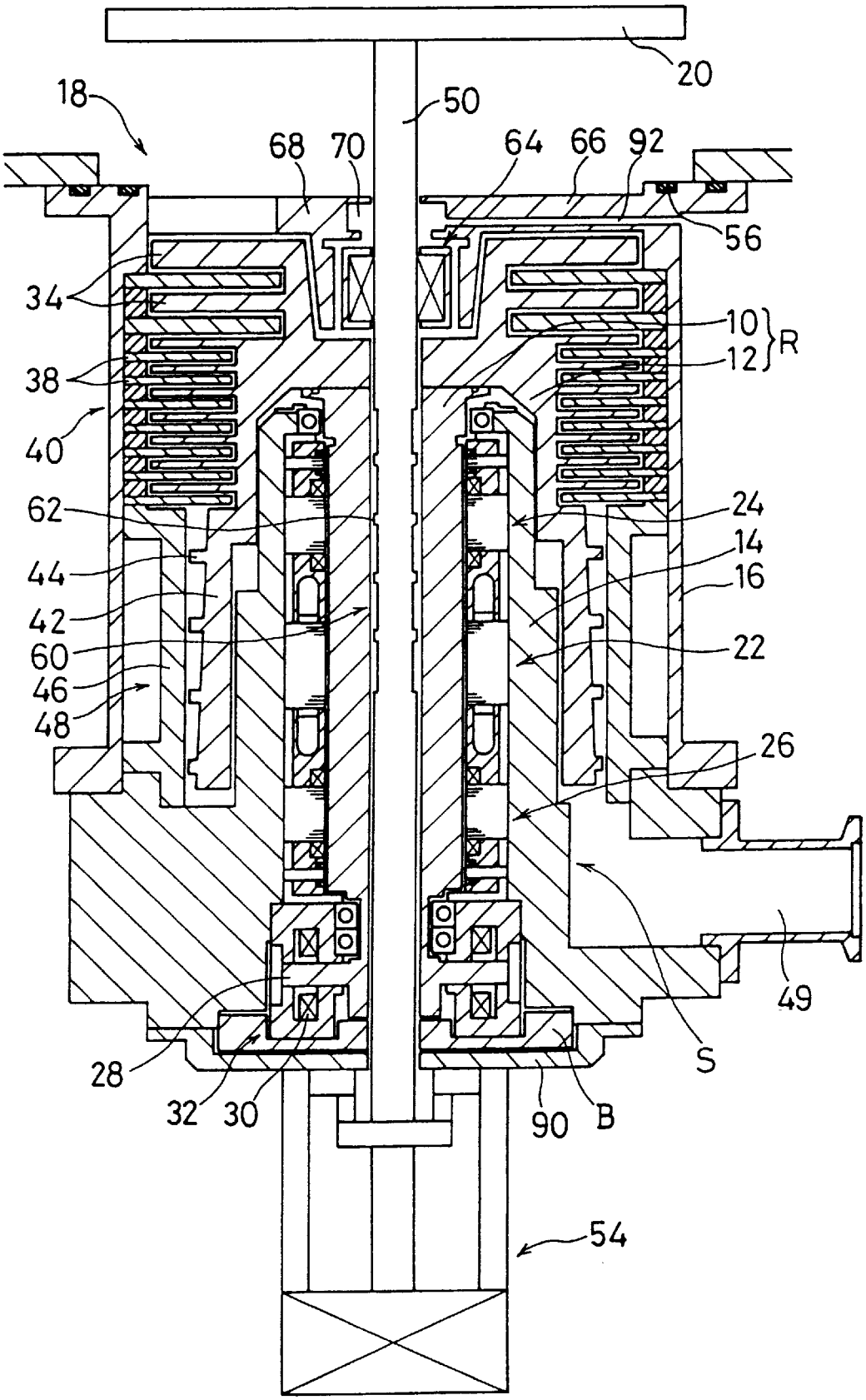
FIG. 3 is a cross-sectional view of a turbomolecular pump according to a third embodiment of the present invention.
Figure 4:
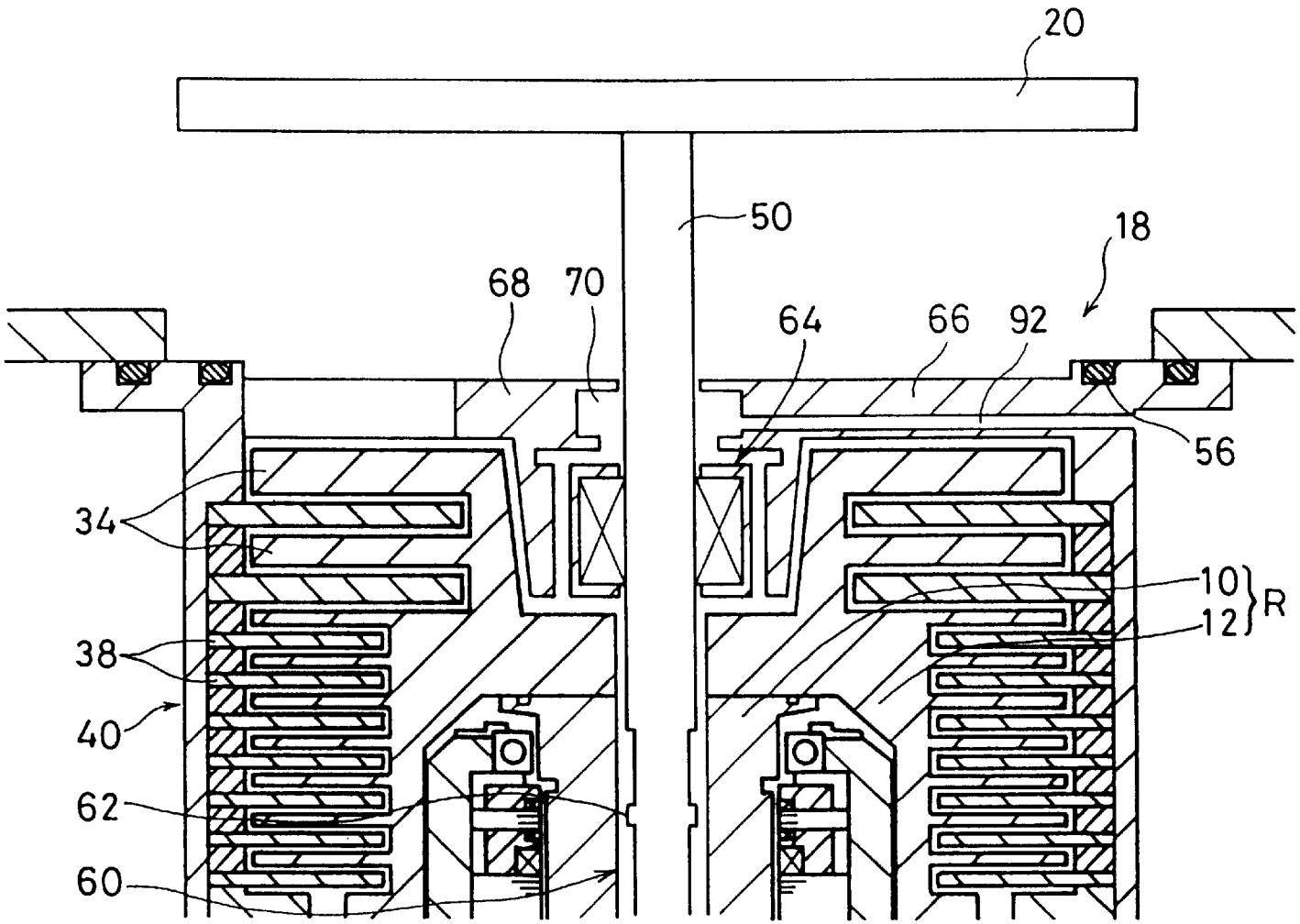
FIG. 4 is an enlarged cross-sectional view showing an essential part of the turbomolecular pump in FIG. 3.

FIG. 3 shows the turbomolecular pump according to the third embodiment of the present invention. The embodiment of FIG. 3 is different from that of FIG. 2 in that a contact type bearing 64 is provided at the intake port side to support the valve rod 50. The bearing 64 is supported by a support member 68 provided at the forward ends of a plurality of arms 66 extending radially inwardly from the casing 16. As shown in an enlarged view of FIG. 4, the support member 68 is spaced from the valve rod 50 to form a small gap, and forms therein a sealed space 70 which surrounds the bearing 64 from the intake port side. Further, a purge gas passage 92 is formed to supply purge gas to the space 70 through the arm 66. In this embodiment, the valve rod 50 is stably supported, and hence the valve element 20 is not displaced and opening or closing of the valve element 20 can be performed smoothly. Further, the purge gas carries downstream particles which may be produced from the bearing 64 to thus prevent contamination of the apparatus to be evacuated.

Figure 5A:
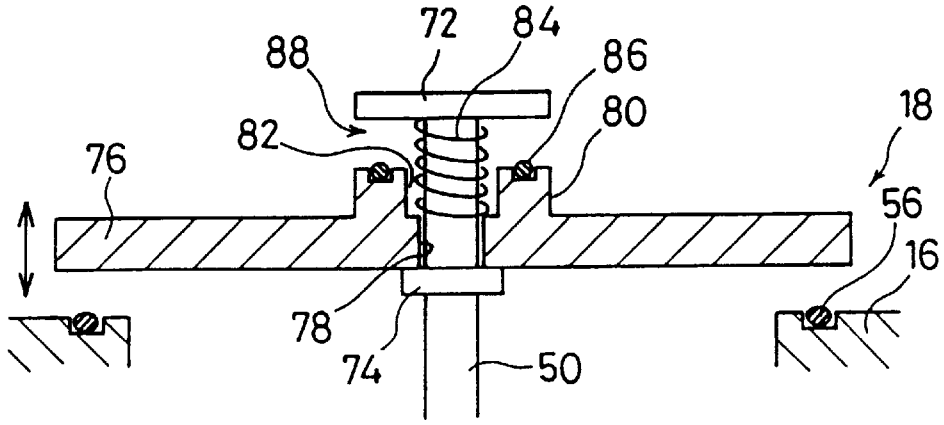
FIGS. 5A, 5B and 5C are cross-sectional views showing a valve, in another embodiment.
Figure 5B:
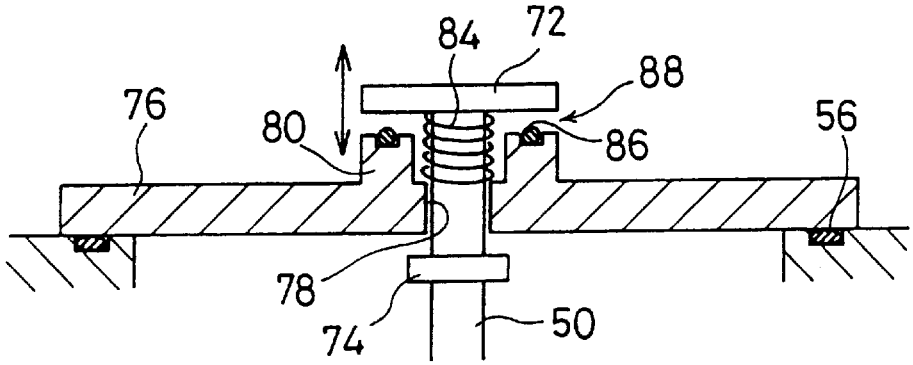
Figure 5C:
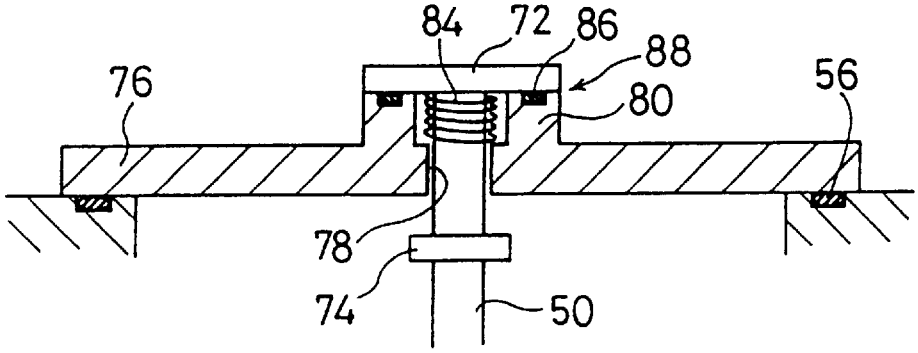

FIGS. 5A, 5B and 5C show the structure of the valve according to another embodiment. In this embodiment, the valve has a double valve element structure comprising an auxiliary valve element 72 attached to the forward end of the valve rod 50 and a main valve element 76 provided between the auxiliary valve element 72 and a stopper 74 provided on the valve rod 50. The valve rod 50 is inserted into an opening 78 having a diameter slightly larger than that of the valve rod 50 and formed in the main valve element 76. The main valve element 76 is supported by the valve rod 50 in such a manner that the main valve element 76 is slidable with respect to the valve rod 50. An annular projection 80 is formed on the upper surface of the main valve element 76, and a spring 84 is provided between a recess 82 formed in the main valve element 76 and the auxiliary valve element 72 to press the main valve element 76 against the stopper 74. A sealing ring 86 is provided on the upper surface of the projection 80 to form a second gate 88 with the auxiliary valve element 72.

With the above arrangement, when the valve rod 50 is lowered from the state in which the main valve element 76 is open as shown in FIG. 5A, the main valve element 76 is brought into a closed state in which the gas intake port 18 is closed by the main valve element 76 as shown in FIG. 5B. At this time, since the main valve element 76 moves apart from the stopper 74, gas is allowed to flow through a gap between the opening 78 and the valve rod 50, and thus a completely closed state of the valve is not accomplished. When the valve rod 50 is further lowered, the auxiliary valve element 72 contacts the upper surface of the projection 80 to thus close the second gate 88 and seal the valve completely as shown in FIG. 5C.

In this embodiment, since the valve has the double valve element structure, the conductance can be adjusted in two steps, and thus the precision of adjustment in the conductance is improved especially in regions where the conductance is small. As a result, the pressure control is facilitated in regions of high pressure.

As is apparent from the above description, according to the present invention, since the actuating mechanism of the valve is provided at an opposite side of the intake port, the gas intake port of the turbomolecular pump can be directly connected to the duct of the apparatus to be evacuated. Further, since the valve actuating mechanism can actuate the valve supporting member for supporting the valve element in a direction of the axis of the rotor, the structures of the valve and its actuating mechanism become simple. Therefore, the overall structure of the turbomolecular pump including the valve can be compact.

Although certain preferred embodiments of the present invention have been shown and described in detail, it should be understood that various changes and modifications may be made therein without departing from the scope of the appended claims.

What is claimed is:

1. A turbomolecular pump comprising:

a casing housing a rotor and a stator therein;

a pumping section comprising said rotor and said stator;

a valve element capable of opening or closing an intake port of said casing;

a supporting member for supporting said valve element, said supporting member extending through at least one of said rotor and said stator; and an actuating mechanism for actuating said valve element, said actuating mechanism being provided at a side opposite to said intake port with respect to said rotor.

2. A turbomolecular pump according to claim 1, further comprising a sealing portion provided between a part of said supporting member and said rotor to prevent counterflow of gas.

3. A turbomolecular pump according to claim 1, further comprising a bearing provided near said intake port for supporting at least a part of said supporting member.

4. A turbomolecular pump according to claim 3, further comprising a gas purge mechanism for supplying purge gas to around said bearing, said purge gas carrying downstream particles which may be produced from said bearing.

5. A turbomolecular pump according to claim 1, further comprising an auxiliary valve element capable of opening or closing an opening formed in said valve element.

* * * * *